United States Patent [19]

McCalla

[11] 4,033,010

[45] July 5, 1977

[54] HANDLES

[75] Inventor: Charles McCalla, Disley, England

[73] Assignee: Flock Development and Research Company Limited, England

[22] Filed: Dec. 10, 1975

[21] Appl. No.: 639,297

[30] Foreign Application Priority Data

Apr. 17, 1975 United Kingdom ..... 15784/75

[52] U.S. Cl. ..... 16/114 R; 15/145; 403/331; 403/330

[51] Int. Cl.[2] ..... A46B 5/02

[58] Field of Search ..... 403/331, 330, 110, 104, 403/363, 409, 381; 15/145; 16/114 R; 248/411, 226 R, 245, 125

[56] References Cited

UNITED STATES PATENTS

| | | | |
|---|---|---|---|
| 845,666 | 2/1907 | Ruckstuhl | 15/145 |
| 882,870 | 3/1908 | Cary | 248/412 |
| 1,215,848 | 2/1917 | Perkins | 403/381 |
| 3,414,929 | 12/1968 | Warner et al. | 15/145 X |
| 3,629,894 | 12/1971 | Stefany | 15/210 R X |
| 3,900,269 | 8/1975 | Pavlot | 403/363 |

*Primary Examiner*—Andrew V. Kundrat
*Attorney, Agent, or Firm*—Prutzman, Hayes, Kalb & Chilton

[57] ABSTRACT

A handle arrangement particularly for a paint pad adapted for releasable engagement with a channel provided on the structure to which the handle is to be applied consists of an apertured base plate a handle member extending upwardly from such base plate and a manually actuable locking means supported within the handle member and adjustable between a first position wherein a part thereof extends through the aperture in the base plate and a second position wherein such part is retracted through such aperture.

9 Claims, 3 Drawing Figures

HANDLES

The invention concerns handles and has particular, though not exclusive reference to handles for paint pads.

It is known in the art to provide a handle for releasable engagement with a channel formation mounted on or formed integrally with the body of a paint pad, the handle having a base plate which is a free sliding fit within the channel, the lateral edges of the plate engaging beneath inwardly directed lips at the longitudinal edges of the channel. In order to maintain the handle in position longitudinally of the channel it is known to provide protruberances at the underside of the plate which bear on the floor of the channel so to deform the channel as to urge the lips of such channel inwardly, thereby gripping the edges of the plate by pressure, such pressure being determined by the amount of deflection of the channel which in turn is controlled by the size of the protruberances.

Having regard to the nature of the materials from which handle and pad body are conveniently made, namely synthetic plastics materials, the rate of wear of the protruberances is such that on repeated application of the handle to and its removal from the channel the security of the attachment quickly deteriorates and the handle becomes loose in the channel, readily moving longitudinally thereof.

The primary object of the invention is to provide a handle for releasably attachment to a channel which is less susceptible to wear, and thus can be used more frequently, than is the case with conventional handles before requiring that the same be discarded and substituted by a replacement handle.

In its broadest aspect the invention proposes a handle arrangement for releasable engagement with a guide formation characterised by spaced lateral guide-engaging edges for cooperation with said guide formation and locking means pivotally mounted on this handle and selectively adjustable between first and second positions thereon respectively representing inoperative and operative conditions of this locking means, the said locking means including a part movable outwardly of the handle on adjustment between said first and second positions for surface co-operation with an opposed structure to urge the guide-engaging edges into frictional engagement with the guide formation.

According to another aspect of the invention there is provided a handle for releasable engagement with a lipped channel which handle comprises spaced opposed lateral edges for engagement with respective opposite longitudinal sides of the channel, a handle member extending from said edges and outwardly of the plane defined thereby and a locking means arranged in association with the handle member and selectively adjustable between a first, or datum, position wherein a part thereof is relatively retracted in relation to the general plane of the edges and a second position wherein said part is displaced outwardly from such plane.

According to a preferred feature, the locking means is mounted within the handle and includes an operating lever extending from said handle, the said operating lever being adapted, upon adjustment, to shift the aforesaid part between the first and second positions.

According to a still further feature of the invention, the said part of the locking means comprises a cam member operably connected with the handle for angular displacement upon adjustment of the locking means.

The invention will now be described further, by way of example only, with reference to the accompanying drawings illustrating two embodiments thereof and in which.

Figure 1:
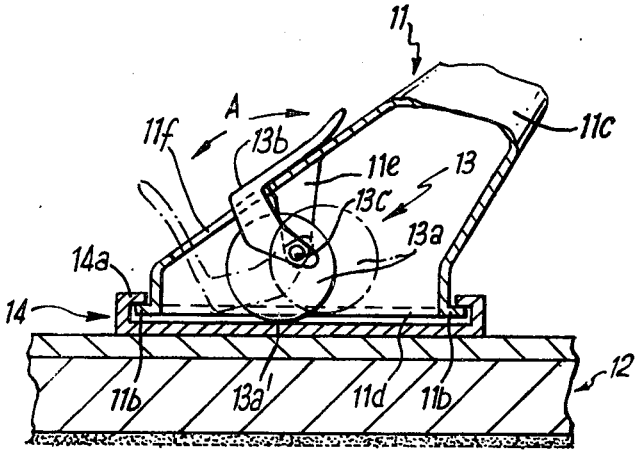
FIG. 1 is a side elevation, partly in section, of a handle as applied to a guide channel provided on the back of a paint pad body.
Figure 2:
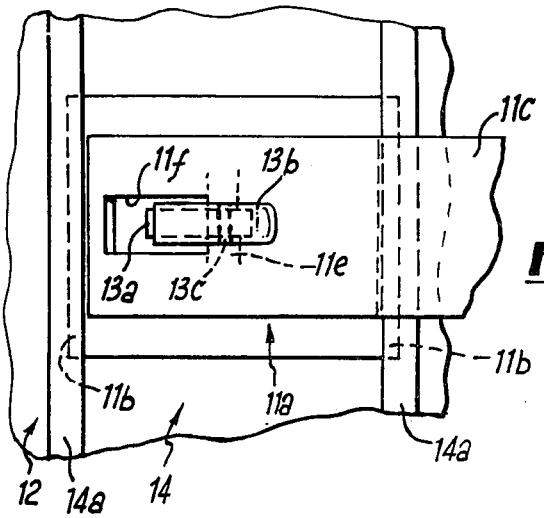
FIG. 2 is a plan view of the arrangement shown in FIG. 1.

Referring now to the drawings, and particularly to FIGS. 1 and 2 thereof, a handle 11 for a paint pad 12 comprises an aperture, generally rectangular base plate 11*a* having opposed lateral edges 11*b*, a hollow handle member 11*c* extending outwardly from the said base plate and in register with the aperture 11*d* therein, and a locking means 13 mounted within the handle member 11*c* and having an edge-cam member 13*a* adjustable between first and second positions wherein the effective cam surface 13*a'* of the cam member lies at one or other side of the plane of the underside of the base plate, respectively.

The base plate 11*a* and handle member 11*c* are conveniently of integrally moulded construction, being produced from a synthetic thermoplastics material, polyethylene or A.B.S. being the preferred material of choice, whilst the edge-cam member 13*a* is made from moulded nylon thereby to provide of a considerable resistance to frictional wear.

The locking means 13 is pivotably supported on and between two lugs 11*e* provided internally of the handle member 11*c* and in spaced disposition transversely of such handle member, such means comprising the cam member 13*a* aforesaid and a cranked manually-actuable lever 13*b* firmly attached thereto, the cam member 13*a* being of disc-like form and being rotatably mounted between the lugs 11*e* for motion about the axis of a support pin 13*c* engaged therewith, the support pin 13*c* being eccentrically positioned with respect to the cam member 13*a*.

An aperture 11*f* if provided in the top wall of the handle member through which cranked lever 13*b* of the locking means 13 protrudes, the lever 13*b* being movable to and from the position shown in FIG. 1 as indicated by arrow A therein.

In use in connection with a paint pad 12, the handle is positioned relative to the pad by engaging the lateral edges 11*b* of the base plate 11*a* with respective lipped longitudinal edges 14*a* of a guide channel 14 secured to the body of the paint pad, the base plate 11*a* being freely slidable in the guide channel 14 with the locking means 13 in an inoperative condition.

In order to secure the handle in a selected position longitudinally of the guide channel, the lever 13*b* is moved from the unlocked position (dotted lines in FIG. 1) to the locked position (full lines in FIG. 1) so that the effective cam surface moves downwardly through the plane of the base plate 11*a* into engagement with the bottom of the guide channel, the lever moving over-centre to reach the "locked" position thereby to be maintained automatically in such locked position with the cam surface in pressure engagement with the channel. The effect of the pressure engagement of the cam surface with the floor of the channel is initially to lift the base plate 11*a* of the handle outwardly relative to the channel so that the lateral edges of the base plate are moved into pressure contact with the lipped edges of the channel. A subsequent effect of the pressure engagement is to move the lips inwardly.

The action is described in more detail as follows:

The cam is so situated that with the handle engaged with the channel it falls to the centre of such channel. The channel, being of a resiliently flexible plastics material, is deformed in a downward direction when the cam is moved to the lock position and because the edges of the base plate of the handle are within the inwardly curved edges of the channel, the resulting pressure secures the handle to the channel. When the cam is moved to the lock position it protrudes approximately ¼inch below the level of the handle base plate and this amount is sufficient to draw the lips of the channel towards each other, thereby creating the required pressure to trap and securely lock the edges of the handle base plate.

To remove the handle, it is necessary only to release the locking means, (dotted-line position of FIG. 1) and slide such handle longitudinally off the guide channel.

As will be appreciated, as the cam member is, in effect, retracted whilst the handle is moved to and from its intended position, such cam member is not subjected to wear and thus the handle will have an improved life as compared with conventional handles of the kind before referred to.

Figure 3:
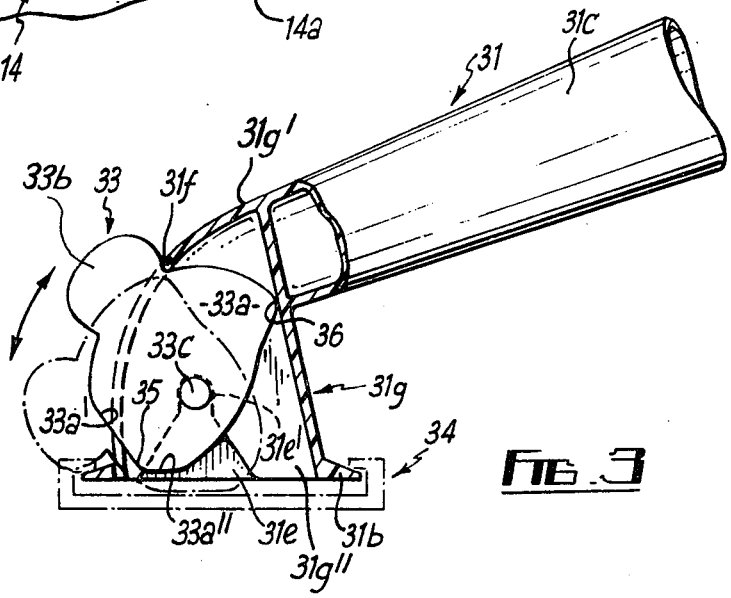
FIG. 3 is a side elevation, partly in section, of a preferred form of handle constructed in accordance with the invention.

In a preferred construction, see now FIG. 3, the handle 31 comprises a conically tubular hand-grip portion 31*c* which merges with an integral, generally frusto-pyramidal shaped housing 31*g* itself terminating in an outwardly directed peripheral flange 31*b*, the respective axes of the hand-grip portion 31*c* and housing 31*g* being mutually inclined at an angle of approximately 90°.

A slot 31*f* is provided in the forward wall 31*g'* of the housing in register with the longitudinal axis of the handle 31*c*, such slot 31*f* extending from a position immediately adjacent to the flange 31*b* to a position adjacent the uppermost extremity of the wall, which wall 31*g'*, as can be seen from the drawing, being of curved construction when viewed in side elevation.

The opposed lateral side walls 31*g''* of the housing are each recessed to define a bearing for a cam member 33*a* pivotally supported on the housing 31*g*, the recess extending from the open end of the housing and comprising a convergent lead-in groove 31*e* and a bearing groove 31*e'*.

The locking means 33 comprises the cam member 33*a* aforesaid, such cam member consisting of an edge cam of generally oval plate-like form, there being axially aligned lugs 33*c* extending from the respective faces thereof for engagement with the bearing grooves 31*e'*. The cam member 33*a* includes a radially extending enlargement 33*b*, which enlargement engages the slot 31*f* in the housing 31*g* to protrude outwardly therefrom thereat to constitute a control member for angular adjustment of the cam member 33*a* about the axis of the aligned lugs 33*c* within limits defined generally by the ends of the said slot. The cam form includes a flat displacement portion 33*a'* co-operable with the floor of the channel 34 with which the handle is engaged when the cam member is in its locked position, as shown in dotted line in FIG. 3, and a clearance portion 33*a''* angularly spaced from such displacement portion and separated therefrom by a node 35, the displacement portion being spaced at a greater distance from the axis of the bearing lugs 33*c*, than the clearance portion, but at a lesser distance than the node 35, the clearance portion 33*a''* being disposed at the handle side of the plane of the plate defined by flange 31*b* in the "unlocked" condition of the locking means and the displacement portion 33*a* ' being disposed beyond and parallel to such plane in the "locked" condition of the locking means.

The cam form includes a further node 36 generally diametrically opposed with respect to that node 35 between the displacement and clearance portions, such further node 36 constituting a stop for abutment with the inner surface of the housing, as shown in FIG. 3, in the "unlocked" condition of the locking means.

The operation of the embodiment shown in FIG. 3 corresponds to that of FIGS. 1 and 2, and no further description thereof is thought to be necessary.

The invention is not restricted to the exact features of the embodiment described and illustrated, since alternatives will readily present themselves to one skilled in the art.

Thus, for example, whilst we prefer that the locking means be provided internally of the handle member, an external mounting may be preferred in some instances. In other arrangements the cam member is provided within the handle member and the actuating lever therefor is arranged outwardly of such member.

As an alternative to the disc-like cam member disclosed, a pivotably mounted, cranked lever operating on a displaceable contact plate engageable with the guide channel may be adopted, the lever moving to an over-centre position in urging the contact plate into engagement with the floor of the channel.

Whilst, in the ordinary course of events, the handle will be engaged with a channel member and will be urged into contact with the underside of inwardly directed lips at the longitudinal edges of such member, it is to be borne in mind that a like guide effect is obtainable by providing upstanding lugs of inverted L-shape cross-section with which the lateral edges of the base plate of the handle, a plurality of spaced such lugs being provided for co-operation with each such lateral edge.

What I claim is:

1. A paint applicator having a guide formation with clamping edges and an intermediate flexible base and releasably receiving a handle arrangement in loose slidable engagement therewith, the said handle arrangement including spaced lateral guide-engaging edges for co-operation with said clamping edges of the guide formation, a handle extending outwardly from a plane defined by the said lateral edges, and locking means pivotally mounted on the handle for pivotal movement about an axis parallel to said plane and selectively pivotally adjustable between first and second positions thereon respectively representing inoperative and operative conditions of the locking means, the said locking means including a cam member having a part movable outwardly of the handle on pivotal adjustment between said first and second positions for co-operation with the flexible base of the guide formation to flex it downwardly to urge the clamping edges toward each other and into frictional clamping engagement with the guide engaging edges, the said second position of the locking means corresponding to an over-center position of the cam member.

2. A handle arrangement in combination with a lipped channel comprising a base plate having spaced opposed lateral edges for engagement with respective opposite longitudinal sides of the channel, a handle member extending from said edges and outwardly of the plane defined thereby and a locking means arranged in association with the handle member and selectively adjustable about a pivot axis parallel to the said opposed lateral edges between a first, or datum, position wherein a part thereof is relatively retracted in relation to the general plane of the edges and a second position wherein said part is displaced outwardly from such plane, the said locking means comprising an edge cam having a periphery for engagement with the lipped channel intermediate the lateral limits thereof when the locking means is in the said second position, which second position represents an over-center position of the cam.

3. A handle arrangement as claimed in claim 2, wherein the locking means is mounted within the handle and includes an operating lever extending from said handle, the said operating lever being adapted, upon adjustment, to shift the said cam between said first and second positions.

4. A handle arrangement as claimed in claim 2, wherein the cam comprises an eccentrically mounted disc-like element and the locking means further includes an operating lever secured to the cam and adapted upon adjustment between the first and second positions to move the cam through an over-center position.

5. A handle arrangement as claimed in claim 4, wherein the operating lever is formed integrally with the cam.

6. A handle arrangement as claimed in claim 4, wherein the cam has angularly spaced displacement and clearance portions at respective distances from the pivot axis of the cam, the displacement portion being spaced from the said pivot axis by a greater distance than the clearance portion but by a lesser distance than a node provided between such portions.

7. A handle as claimed in claim 2 in combination with a paint pad, the said paint pad including a body part and a lipped channel formation on such body part, the handle being engaged with such channel formation and retained therein by cooperation between the lateral guide-engaging edges of the handle and the lips to the channel formation, the edge cam periphery being engageable with the bottom of the channel and adapted, in the second displaced position of the locking means, to urge the lips of the channel into frictional engagement with the said guide-engaging edges of the handle.

8. A handle structure with an applicator support having a pair of spaced upstanding clamping ribs and an intermediate base adapted to be flexed downwardly for drawing the ribs inwardly for clamping the handle structure to the support, the handle structure having a base with a pair of spaced flanges, a handle extending upwardly from a plane of the handle base and locking means pivotally mounted on the handle about an axis generally parallel to said plane and selectively pivotally adjustable between a release position and a locking position, the handle base being adapted, with the locking means in its release position, for being freely detached from and freely attached to the applicator support with its flanges between and in loose interlocking relationship with the clamping ribs of the applicator support, the pivotal locking means having a pivotal cam with a cam part movable downwardly to a pivotal over-center position on pivotal adjustment of the locking means from its release position to its locking position and thereby operable, with the handle structure attached to the applicator support, for engaging the intermediate base of the applicator support and flexing it downwardly for drawing the opposed clamping ribs toward each other and inwardly into clamping engagement with the flanges of the handle base for clamping the handle structure to the applicator support.

9. A handle structure according to claim 8 wherein the handle is hollow, wherein the cam is pivotally mounted within the hollow handle and wherein the locking means comprises an operating lever extending generally radially outwardly from the cam and manually operable for pivotally adjusting the locking means between its said release and locking positions.

* * * * *